United States Patent [19]

Fox

[11] Patent Number: 4,501,369

[45] Date of Patent: Feb. 26, 1985

[54] MERCHANDISE DISPLAY MEANS

[75] Inventor: Clifford R. Fox, Chelmsford, England

[73] Assignee: CBM Display Group Limited, Woodford Green, England

[21] Appl. No.: 331,215

[22] Filed: Dec. 15, 1981

[30] Foreign Application Priority Data

Dec. 23, 1980 [GB] United Kingdom ..... 8041115

[51] Int. Cl.[3] ..... A47F 5/00

[52] U.S. Cl. ..... 211/133; 108/111; 108/144; 211/59.1; 211/187

[58] Field of Search ..... 211/57.1, 59.1, 54.1, 211/153, 133, 207, 208, 187; 108/106, 56.1, 108, 111, 144, 83; 248/214, 222.2, 307; 206/557, 558; 220/23.2, 23.4, 80

[56] References Cited

U.S. PATENT DOCUMENTS

| | | | |
|---|---|---|---|
| 2,665,869 | 1/1954 | Samuels | 211/59 |
| 2,849,123 | 8/1958 | Magill | 211/153 X |
| 3,132,609 | 5/1964 | Chesley | 108/106 |
| 3,388,806 | 6/1968 | Cunningham et al. | 211/59.1 X |
| 3,424,111 | 1/1969 | Maslow | 108/144 |
| 3,606,069 | 9/1971 | Hanison | 220/80 X |
| 3,664,274 | 5/1972 | Bustos | 108/144 |
| 3,675,598 | 7/1972 | Kesilman et al. | 108/144 |
| 4,138,953 | 2/1979 | Tashman | 108/144 |

FOREIGN PATENT DOCUMENTS

| | | | |
|---|---|---|---|
| 246703 | 9/1963 | Australia | 211/133 |
| 528403 | 5/1954 | Belgium | 211/187 |
| 2329234 | 5/1977 | France | 108/108 |
| 909033 | 2/1959 | United Kingdom . | |

*Primary Examiner*—Robert W. Gibson, Jr.

*Attorney, Agent, or Firm*—Berman, Aisenberg & Platt

[57] ABSTRACT

A merchandise display assembly has a frame with two upright support stems, and a number of trays each with tubular portions on opposite sides which engage the stems in a manner which allows vertical adjustment of the trays. The assembly also includes wire frames extending between the stems and supporting wire prongs.

4 Claims, 19 Drawing Figures

Fig. 3a.
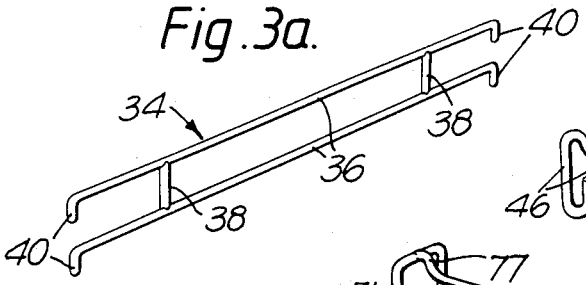
Fig. 3b.
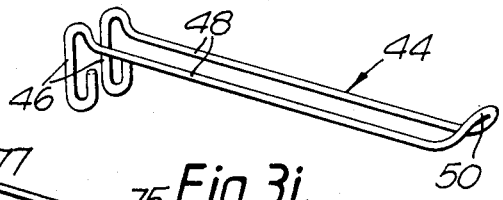
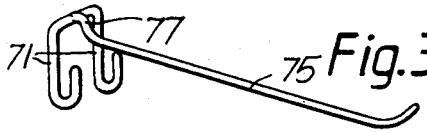
Fig. 3i.
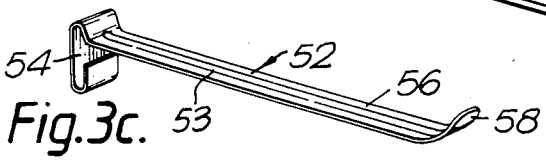
Fig. 3c.
Fig. 3e.
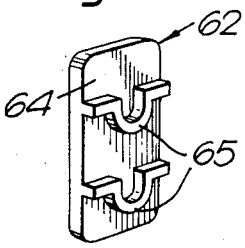
Fig. 3d.
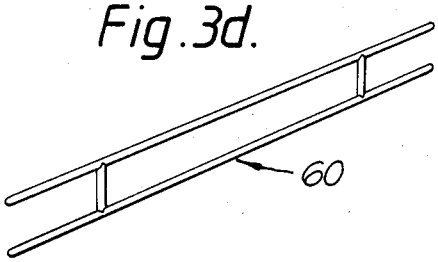
Fig. 3f.
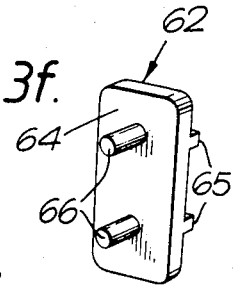
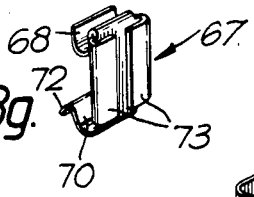
Fig. 3g.
Fig. 4.
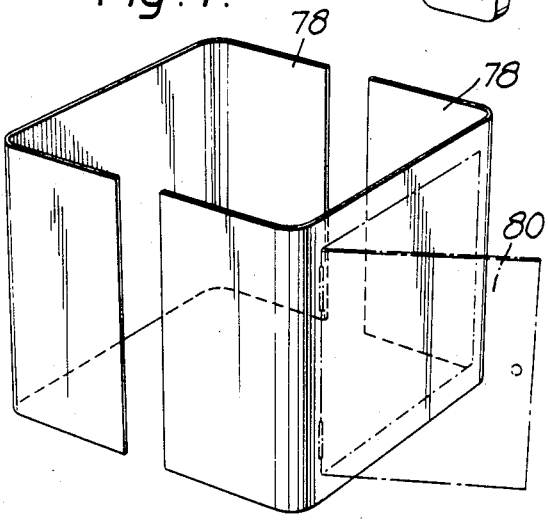
Fig. 3h.
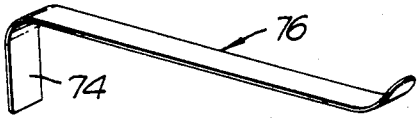

MERCHANDISE DISPLAY MEANS

The present invention relates to the display of merchandise, and in particular to a tray for displaying merchandise and an assembly for arranging a number of such trays one above the other.

Trays have been stacked in this way hitherto by means of L-sectioned elongate corner support sections. Each tray is formed with recesses at its corners, both in its upper side and in its underneath side. One tray is placed on a base. Four corner sections are then inserted into the recesses at the corners of the tray in its upper side, to extend vertically upwardly therefrom. Another tray is then seated on these sections with the upper ends thereof received in the recesses formed at the corners of the second tray in its underside. The assembly is built up further until as many as five or six trays are supported in the stack. A box providing surfaces for graphic material may be positioned on the top tray, and further graphic material may be arranged on the base.

One problem encountered with this arrangement is its lack of flexibility. Unless many sections of different length are made and sold with any given system, the vertical spacing between each tray has to be the same all the way up the stack, being equal to the length of one of the support sections. This results in much wasted display space since the products to be displayed, even if all related to one field such as cosmetics or perfumery, will have different heights. Conversely, if many sections of different length are made, the cost of production for one system is undesirably high, and many spare sections have to be stored while the assembly is erected with one choice of spacings between the various trays if it is desired subsequently to alter those spacings.

It is an aim of one aspect of the present invention to overcome this problem.

With this aim in view, the present invention is directed to a tray or tray part for displaying merchandise having at least one tubular portion or other engagement means on or at an edge of the tray or tray part which allows the tray or tray part to be slid up and down vertically extending supporting means. Locating means may be provided at the engagement means or on the vertically extending supporting means for fixing the tray at any selected height on the vertically extending supporting means.

If the engagement means are tubular portions, preferably of rectangular or square box section, vertically extending rods or tubes of corresponding external cross section may extend through the tubular portions so that the tray or tray part may be slid up and down the rods or tubes.

The locating means may comprise a wedge-shaped abutment member having a spigot which can be inserted into a hole or recess in the upright supporting means or vice versa.

According to a second aspect of the present invention, it provides a merchandise display assembly comprising at least one free-standing elongate upright support member and at least one tray or other merchandise retaining means supported by the upright member in a manner allowing vertical adjustment of the merchandise retaining means. Preferably, there are two upright support members with the merchandise retaining means extending therebetween.

If the merchandise retaining means is a tray, it may be in accordance with the first aspect of the present invention. Alternatively it may comprise prongs from which can be suspended suitable goods. Or trays and prongs may be supported on the same pair of upright support members.

The upright members may be tubes made of extruded plastics material, or aluminium or steel depending on the maximum pay load that the merchandise retaining means are intended to support.

According to a further aspect of the present invention, there is provided at least two trays each with a peripheral groove at least one one side, and one or more panels, which may be in generally U-shaped form or of box-section form, extending between the trays and having edges engaging the grooves of the trays so that one tray may thereby be supported above the other.

Examples of trays and display assemblies in accordance with the present invention are illustrated in the accompanying drawings, in which.

Figure 1:
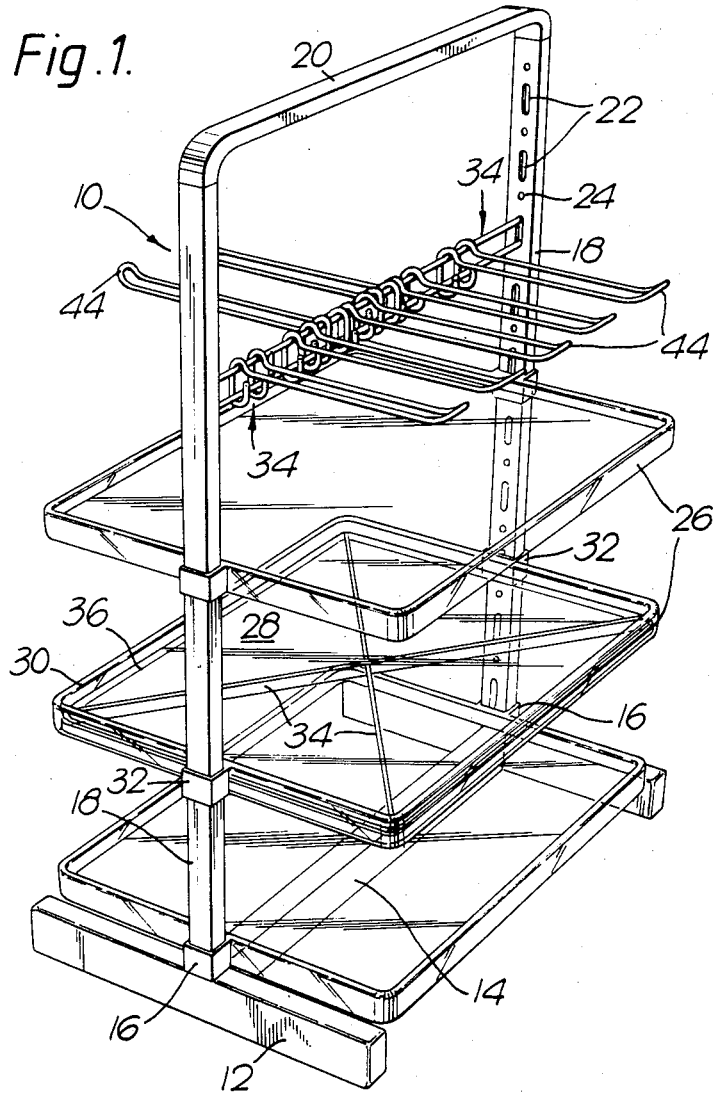
FIG. 1 shows a perspective view from above of a tray assembly made in accordance with the present invention.
Figure 5:
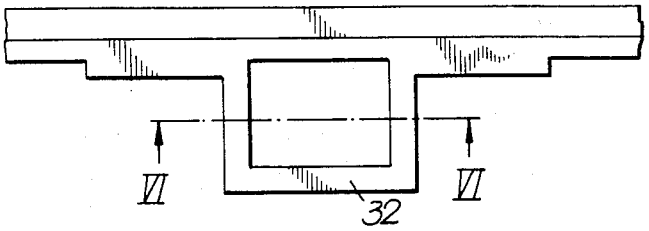
Figure 6:
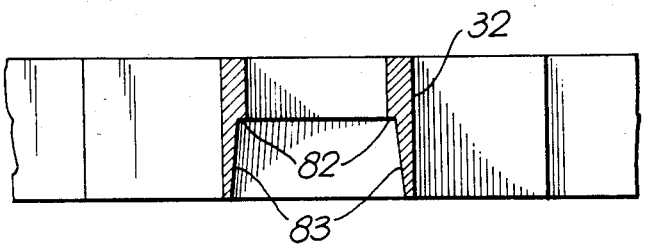
Figure 7:
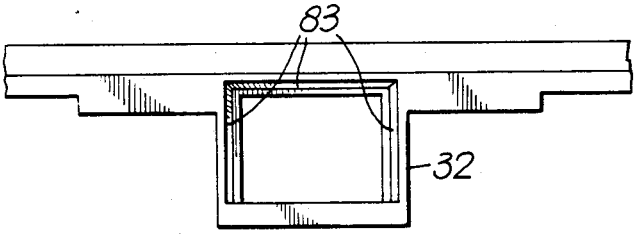
Figure 8:
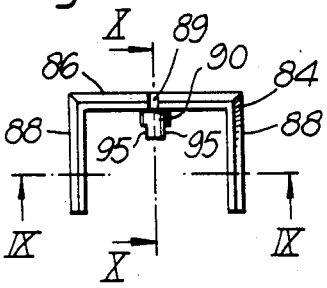
Figure 9:
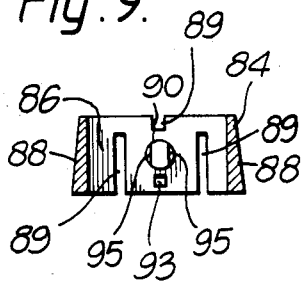
Figure 10:
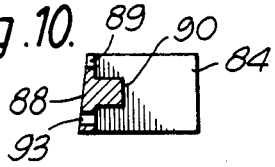
Figure 11:
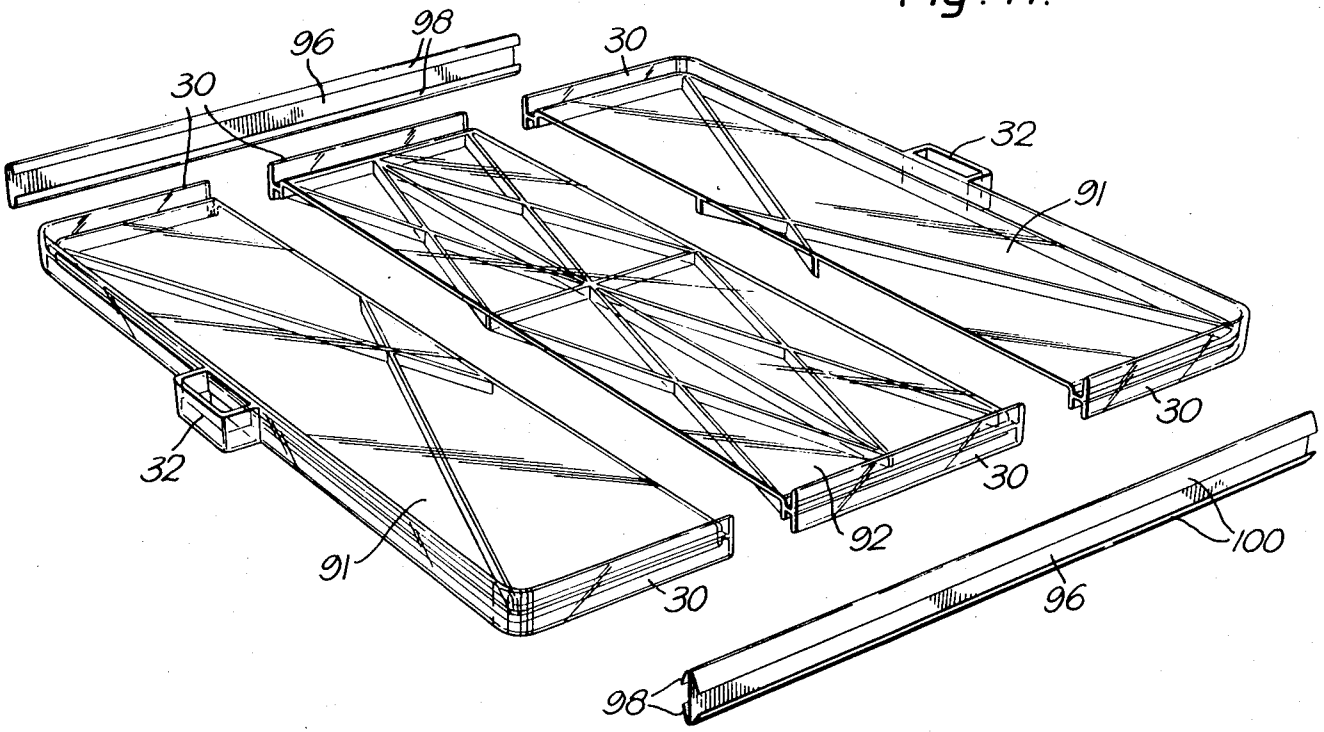

FIGS. 3*a* to 3*i* show perspective views of various components which can be used to make up the prong assembly shown in FIG. 1;

FIG. 4 shows a perspective view of curved intermediate panels that can be positioned between two trays which are arranged one above the other;

FIG. 5 shows a plan view of a part of a tray shown in FIG. 1 on an enlarged scale;

FIG. 6 is a sectional side view of the part of a tray shown in FIG. 5 taken along the line VI—VI in that Figure;

FIG. 7 is an underneath view of the part of the tray shown in FIG. 5;

FIG. 8 shows a plan view of a locating member for locating a tray on the frame shown in FIG. 1;

FIGS. 9 and 10 show respective sectional views of the locating member shown in FIG. 8 taken along the lines IX—IX and X—X therein; and FIG. 11 is an exploded view of a modified form of tray.

The tray assembly shown in FIG. 1 has a substantially square-sectioned tubular frame 10 comprising an H-shaped base 12 which lies horizontally on a shop floor or shelf and from opposite ends of the cross-piece 14 of which extend upright tubular sections 16. Upright tubular stems 18 of the frame have narrowed lower ends (not shown) inserted into the upright sections 16 of the base 12, and further stability is achieved by an upper horizontal tubular length 20 which has downwardly extending end portions which are narrowed and inserted into the upper ends of the upright stems 16. The inside wall of each upright section is perforated by elongate longitudinally-extending slots 22 and/or round holes 24 spaced apart along the length of the stems. The frame may be made of extruded synthetic plastics material, extruded anodized aluminium, or steel. If made of metal, the frame could be made of channel or H-section lengths and still have adequate strength.

A number of injection moulded plastics trays 26 are supported one above the other on the frame 10. Each tray 26 comprises a flat plate 28 which in this instance is a square of approximately 16 inches (41 cms×41 cms), although many other dimensions are possible. A 1.$\frac{5}{8}$ inch (41 mms) high wall 30 extends all the way around the perimeter of the plate 28, with about as much of the wall extending below the plate as extends above it. Two inmoulded U-shaped portions of plastics material project outwardly from wall portions at opposite edges of the tray 26 to define, with those wall portions, two tubular portions 32 of box section. The internal dimensions of the box section are about 1 inch by 1 inch (27 mm by 27 mm).

Two in-moulded reinforcing ribs 34 extend diagonally across the underside of the tray 26 from corner to corner, being integral with the underside of the plate 28. The ribs are in the form of strips with their widths extending vertically so that they yield least easily in a downward direction, the direction in which merchandise supported by the tray will act on the plate 28. The various parts of the tray are approximately 0.1 inch (2.5 mms) thick. The tray 26 is formed on its upper and lower main faces with grooves 36 around its perimeter immediately adjacent to the wall 6.

The trays 26 are supported on the frame 10 by means of their tubular portions 32. The two stems 18 of the frame extend through these portions 32 respectively, and the latter abut locating elements (not shown in FIG. 1) which engage the slots 22 and/or holes 24 in these stems 18. To allow this, the external cross-section of the tubular stems 18 is slightly smaller than the internal cross-section of the tubular portions 32 of the trays 26, to give a loose fit of the tubular portions 32 around the upright stems 18.

Figure 2:
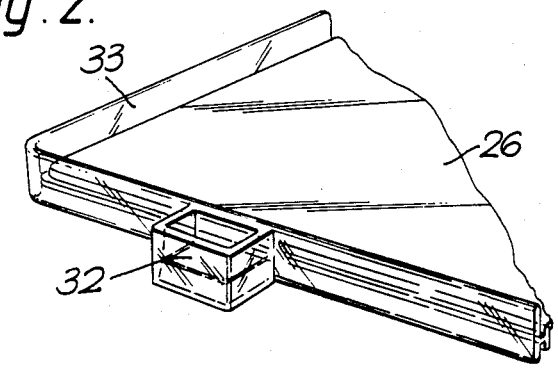
FIG. 2 shows a perspective view of part of a modified form of tray.

FIG. 2 shows a modified form of tray in which the tubular portions 32 (only one of which is shown in FIG. 2) are positioned close to an intended rear edge 33 of the tray 26, whereby the tray will project more from one side of the frame 18 than the other when supported thereby.

A different form of merchandise retaining means supported by the tubular frame 10 is shown in greater detail in FIGS. 3*a* and 3*b*. It comprises an elongate wire frame 34 of 3/16 inch (5 mm) rod made up of two parallel horizontal lengths 36 whose ends 40 are bent downwardly and which are spaced apart by bridging portions 38. The length of the frame 34 is just a little over 16 inches (41 cms) so that the ends 40 of the wire frame 34 may be inserted in respective slots in the two stems 18 which are at the same level, the same stems being used to support trays 26 as shown in FIG. 1. Resilient wire prongs 44 such as that shown in FIG. 3*b* comprises two substantially parallel lengths of wire (in this case belonging to the same single piece of wire) which are bent to give the prong 44 a substantially C-shaped clip 46 at one end, an elongate part 48 which is horizontal when the prong is mounted for use and from which can be suspended various types of merchandise, and an upturned free end 50 to prevent such merchandise slipping off accidentally. The inner internal vertical extent of the C-shaped clip 46 is a little less than the spacing between the length 36 of the wire frame 34. This allows the clip 46 to be snapped on to the wire frame 34, and subsequently slid therealong to any desired position.

FIG. 3*c* shows a prong 52 made of synthetic plastics material and, like the wire prong 44, has a C-shaped clip 54, an elongate horizontal portion 56 reinforced by a longitudinally extending rib 57, and an upturned free end 58. It functions in a manner precisely analogously to the wire prong 44.

A wire frame 60 shown in FIG. 3*d* without downwardly turned ends can be mounted securely in the tubular frame 10 using round holes therein, rather than slots, by means of locating blocks 62 each as shown in FIGS. 3*e* and *ef*. Each block 62 comprises a vertically extending plate 64 from a rear side of which project two circularly-cross-sectional spigots 66 sized and spaced to enter respective holes in one of the upright stems 18 of the main frame 10, and on a front side of which are two U-shaped lugs 65 onto which can be seated adjacent ends of the parallel wires of the wire frame 60.

A plastics clip 67 shown in FIG. 3*g* has upper and lower resilient hooks 68 and 70, the lower hook 70 having a downwardly turned lip 72, which allows the clip to be snapped on to one of the wire frames 34 or 60. On the opposite side of the clip 67 to the hooks 68 and 70 are inwardly turned vertically-extending edges 73. These allow a downwardly turned end 74 of a more simple plastics prong 76 shown in FIG. 3*h* to be slid into the clip 67. The clip may then be slid along the wire frame 34 or 60 to the desired position. The modified prong shown in FIG. 3*i* has a clip 73 having two polycarbonate hooks similar to the clip 46 in the FIG. 3*b* form, but only one length of polycarbonate 75 to form the actual prong with a hump 77 where it meets a bridge portion between the two hooks. The hump constitutes the upper part of the clip 73.

A further accessory for the trays is shown in FIG. 4 comprising two clear acrylic or plastics U-shaped panels 78 designed to be positioned between two trays which are one above the other. Upper and lower edges of the two panels may be located in the grooves 36 of the trays 26, and prevent pilfering whilst allowing the goods on the lower tray to be viewed. The trays may be supported entirely by such panels, allowing the frame 10 to be dispensed with. In this mode of use, the tubular portions 32 at the sides of the tray are not necessary. If the panels are used as graphics areas only, they do not have to be transparent and may be made of card material. A further possibility is to make the panels out of an opaque material, with one of the panels being provided with a lockable door 80. These panels may then be placed at the bottom of a stack of trays 26 of a floor-standing unit, for example, to provide a lockable stock box for back up stock of additional merchandise not actually on display on the unit. Alternatively, one of the panels could be formed with a hole (not shown) to allow bags of crisps, for example, to be sold in the tumble mode.

One means by which the trays 26 can be located at any desired level on the frame 10 is illustrated in FIGS. 5 to 10. The interior of each tubular portion 32 of a tray 26 is undercut on the inside wall and the two projecting side walls to define shoulders 82 below which the interior surfaces 83 slant outwardly so that the interior of the tubular portion 32 widens towards its bottom. A substantially U-shaped abutment member 84 has an outer shape which conforms to the interior of the tubular portion 32. Thus it has a rear portion 86 and two arms 88 projecting from the ends of the rear portion 86. The rear portion and each arm is flared from a top of the member 84 to its bottom. The abutment member 84 has a locating spigot 90 projecting inwardly from the centre of the rear portion 86 in the direction of the arms 88. It also has grooves or slots 91 in its rear portion 86, one downwardly from the upper edge thereof towards the spigot 90, and two either side of the spigot 90, extending upwardly from the lower edge of the rear portion 86, and ending just above the lower end of the slot which extends from the upper edge. There is also a through hole or slot 93 underneath the spigot 90 and between the two longer slots. These slots enable the abutment member 84 to yield, so that the arms 88 are brought closer together if the upright stems are of slightly less width than usual. Vertical flats 95 may be formed on the spigot 90 to allow the latter to engage either a round hole or a somewhat narrowed slot. The angle between each arm 88 and the rear portion 86 of the abutment member 84 may be slightly less than 90°, so that it may grip an upright stem 18.

To support a tray 26 on the frame 19 as shown in FIG. 1, one abutment member 84 is located on one of the upright stems 18 at the desired height for the tray by inserting the spigot 90 into one of the holes or slots in the stem 18. In this position, the arms 88 of the abutment member 84 embrace the stem 18. Another abutment member 84 is located similarly on the other stem 16 at the same level. A tray 26 with its tubular portions 32 on the two stems 18 respectively may now be slid downwardly on the frame 10 until the abutment members 84 are received by the tubular portions 32. In addition to the abutment of the members 84 against the interiors of the tubular portions 32 to prevent the tray slipping further down the frame 10, the wedge shape of the abutment members 84 results in a wedging action, whereby the greater the downward force exerted on the tray, the tighter the grip of the abutment members 84 on the stems 18. To bring this about, the tubular portions 32 of the tray and the abutment members 84 are so dimensioned that a tight fit between them is brought about before the top of the abutment members 84 touch the shoulders 82.

FIG. 11 shows a tray unit of variable width. The unit comprises two end sections 91 each with a tubular portion 32 and each being slightly more than half of one of the trays 26 shown in FIG. 1, a centre section 92 being effectively a centre-slice from one of the trays 26 but having additional reinforcing ribs 94 on its underside, and two elongated extruded channel-section PVC strips 96. The strips 96 may alternatively be made of some other suitable synthetic plastics material, or aluminium, rolled steel or other metal. The longitudinal edges 98 of the strips are turned inwardly through a full 180° to define the channels of the strips. The internal width of the strips is just greater than the width of the peripheral walls 30 of the tray sections, so that an end section half-tray can be threaded onto the strips, then the centre section, and finally the other end section, to form a tray of increased width. Bosses and recesses (not shown) may be provided along the touching edges of the tray sections to engage one another and give increased mutual support to the tray sections.

A number of different widths of centre section 92 may be made available. Not only does this provide a range of different possible widths of tray, the shortest width being obtained by leaving out the centre section altogether, but it also allows relatively large trays to be made from relatively small injection moulding tools.

The strips 96 may have inwardly turned lips 100 along their longitudinal edges on their outsides. Graphic inserts such as pre-printed strips of plastic/-card may be slipped underneath these lips.

I claim:

1. A merchandise display assembly comprising at least one elongate support member which is upright when in use, merchandise retaining means supported by said at least one elongate support member, tubular engagement means of said merchandise retaining means at an edge thereof through which tubular engagement means extends said elongate support member to allow the merchandise retaining means to be slid up and down said elongate support member, locating means which is generally U-shaped and also wedge shaped, engagement means of said locating means to allow the latter to engage said elongate support member selectively at any one of a number of different heights, said tubular engagement means of said merchandise retaining means resting on said locating means when the assembly is in use, and two arms of said locating means, being the two arms of the "U", which extend in substantially the same direction as one another and which embrace said elongate support member when said locating means engages said elongate member, and positively grip the latter owing to a wedging action brought about by said engagement means of said merchandise retaining means resting on said locating means when the assembly is in use.

2. An assembly according to claim 1 in which the said engagement means of said merchandise retaining means has a downwardly facing abutment surface downward movement of which is limited by an upwardly facing surface of said locating means when the assembly is in use.

3. An assembly according to claim 1, in which said merchandise retaining means comprises a tray having two tray parts each having at least one tubular engagement means portion at an edge of the tray part to allow the tray to be slid up and down said upright elongate support member, the tray parts each having peripheral edge walls and the tray further comprising two channel-sectioned strips, in which said peripheral edge walls of said two tray parts are slid into engagement with said two channel-sectioned strips to hold the tray parts together.

4. A merchandise display assembly comprising at least one elongate support member which is upright when in use, a tray having tubular engagement means at an edge of the tray to allow the tray to be slid up and down said elongate support member, locating means which is generally U-shaped and also wedge-shaped and has engagement means to allow said locating means to engage said elongate member selectively at any one of a number of different heights, said engagement means of said tray resting on said locating means when the tray is in use, the interior of said engagement means of said tray having an interior which corresponds with the exterior of the wedge-shaped locating means, a spigot of said locating means and spigot-receiving formations spaced apart along the length of said elongate support member, said spigot being adapted to engage in any one of said spigot-receiving formations, two arms of said locating means which extend in substantially the same direction as one another and which embrace said elongate support member, and positively grip the latter owing to a wedging action brought about by said engagement means of said tray resting on said wedge-shaped locating means when the assembly is in use, and a downwardly directed abutment surface of said engagement means of said tray downward movement of which is limited by an upwardly directed surface of said locating means when the assembly is in use.

* * * * *